United States Patent [19]

Johnson

[11] 4,153,962

[45] May 15, 1979

[54] UNDERSEA TETHER/TERMINATION ASSEMBLY

[75] Inventor: Norman F. Johnson, San Diego, Calif.

[73] Assignee: The United States of America as represented by the Secretary of the Navy, Washington, D.C.

[21] Appl. No.: 864,944

[22] Filed: Dec. 27, 1977

[51] Int. Cl.[2] ..... B63B 21/52

[52] U.S. Cl. ..... 9/8 R; 403/57; 403/76; 248/341

[58] Field of Search ..... 403/56, 57, 74, 76, 403/78, 121, 122; 248/318, 324, 341; 272/78; 24/115 R; 294/74 R, 83 R, 84; 73/103; 9/8 R, 8 P, 8.3; 114/230; 61/4.5, 85; 308/2 R

[56] References Cited

U.S. PATENT DOCUMENTS

| | | | |
|---|---|---|---|
| 1,776,649 | 9/1930 | Boykin, Jr. | 403/76 |
| 2,201,046 | 5/1940 | McLain | 308/2 R |
| 2,960,348 | 11/1960 | Sarowski et al. | 403/56 |
| 3,800,347 | 4/1974 | Zuurbier | 9/8 R |

FOREIGN PATENT DOCUMENTS

| | | | |
|---|---|---|---|
| 470566 | 7/1972 | U.S.S.R. | 61/5 |

*Primary Examiner*—Trygve M. Blix
*Assistant Examiner*—Jesus D. Sotelo
*Attorney, Agent, or Firm*—Richard S. Sciascia; Ervin F. Johnston; Thomas Glenn Keough

[57] ABSTRACT

A tethered termination assures that a float is held at and below the water-air interface to dissipate the dynamic energy of surface waves. The termination is secured to a ballast from which the tether reaches upwardly to the float. Splicing a wire rope or synthetic line onto a ball and socket termination avoids bending the rope or line since all motion occurs across the ball and socket to assure a corrosion and failure free operation over millions of oscillation cycles by the float.

3 Claims, 3 Drawing Figures

UNDERSEA TETHER/TERMINATION ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Recently the tethered float breakwater (TFB) concept has received a good deal of attention. Tethered float breakwaters operate on the principle that hundreds or even thousands of floats held at or slightly below the water's surface and arranged in a matrix can dissipate the effects of surface wave action. Scientists, by observing the period of the waves etc. can design individual tethered floats to have a period corresponding to the period of the waves. Simple pendulum theory is relied upon to give designers the necessary parameters for the length of the tether and the buoyancy of the floats to produce the desired period.

As a result of observing several prototypes it became apparent that one problem kept reappearing. Where the tether was terminated or anchored on a ballast the tethers would become fatigued and part. A critical bending radius where the tether was anchored on the ballast could not be exceeded or there was failure at this point. One attempt at remedying this problem employed a few links of chain connecting the tether to an anchor. However, after a short period of time the chain showed objectionable levels of wear and the arrangement would separate after only a relatively short period of time. The design life of a TFB is expected to be in the nature of five years. Studies have shown that during this five year period the tether termination must withstand over 19 million cycles of flexure as the float oscillates about its vertical axis. This oscillation can be as great as 17° from the vertical axis by a float having a three to four thousand pound buoyancy. Rigid shackle arrangements as well as the chain linkage mentioned above simply would wear through after only a fraction of the 19 million plus duty cycles. In addition, the shackles and chains reacted adversely to the corrosive marine environment. Thus, there is a continuing need in the state of the art for a tether termination having a duty cycle exceeding millions of oscillations and which is not reactive to the corrosive marine environment.

SUMMARY OF THE INVENTION

The present invention is directed to providing an apparatus for terminating a tether extending to a float maintained at and below the water-air interface onto a ballast. A first means is mounted on the ballast for assuring a lubricated pivotal support. A second means is spliced to the tether and has a mating surface for mechanically cooperating with the lubricated pivotal support assuring means to allow tethered oscillations of the float over several million cycles.

It is an object of the invention to provide an improved tether termination.

Another object is to provide a tether termination that, by its simplicity, is reliable and relatively inexpensive.

Another object is to provide a tether termination which will prevent work hardening of the tether and a consequent failure.

Still another object of the invention is to provide a tether termination which is fabricated to render it impervious to the ambient effects of the marine environment.

Another object is to provide a ball and socket tether termination.

Still another object is to provide a tethered termination that is ideally suited for long term TFB applications.

These and other objects of the invention will become more readily apparent from the ensuing specification when taken together with the drawings.

DESCRIPTION OF THE PREFERRED EMBODIMENTS

Figure 1:
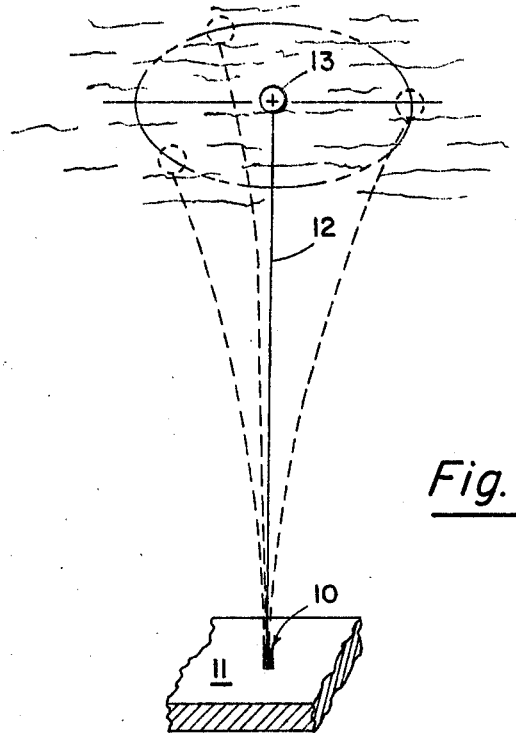
FIG. 1 is an isometric depiction of a float tether termination and ballast such as found in a TFB.

Referring now to the drawings, a tether termination 10 secured onto a ballast 11 is coupled to a tether 12 which maintains a float 13 at or slightly below the water-air interface. This arrangement is consistent with individual flotation units which make up a growing family of TFBs.

The TFB is a new type of breakwater. It employs a large number of submerged floats tethered to a ballast which provides, among other functions, a spaced grid and sufficient weight to hold the floats at or near the water's surface. These floats and their tethers form upside-down pendulums tuned to oscillate out of phase with wave particle motion. Drag induced by the moving floats expends wave energy and thereby reduces wave height.

The function of the tether is to maintain the floats at a fixed distance above the ballast while allowing them to oscillate freely in all planes about an axis formed by a line extending from the base of the tether and perpendicular to the ballast, see FIG. 1. Each float and tether form a pendulum having a natural frequency equal to that of the most significant waves which the TFB is to attenuate.

Two of the significant types of TFBs tested to date are the marina TFB and the open-ocean TFB. The primary difference as far as tether problems are concerned, is the size and buoyancy of the floats used. Marina TFBs use floats about twelve inches in diameter while the open-ocean TFB floats are three feet or greater in diameter. The smaller marina TFB float provides twenty-seven pounds buoyancy and a five foot diameter float provides three to four thousand pounds. Thus, it can be seen that the open ocean design would be harder to provide with a suitable tether termination because of the tensions and the increased levels of wave action.

Figure 2:
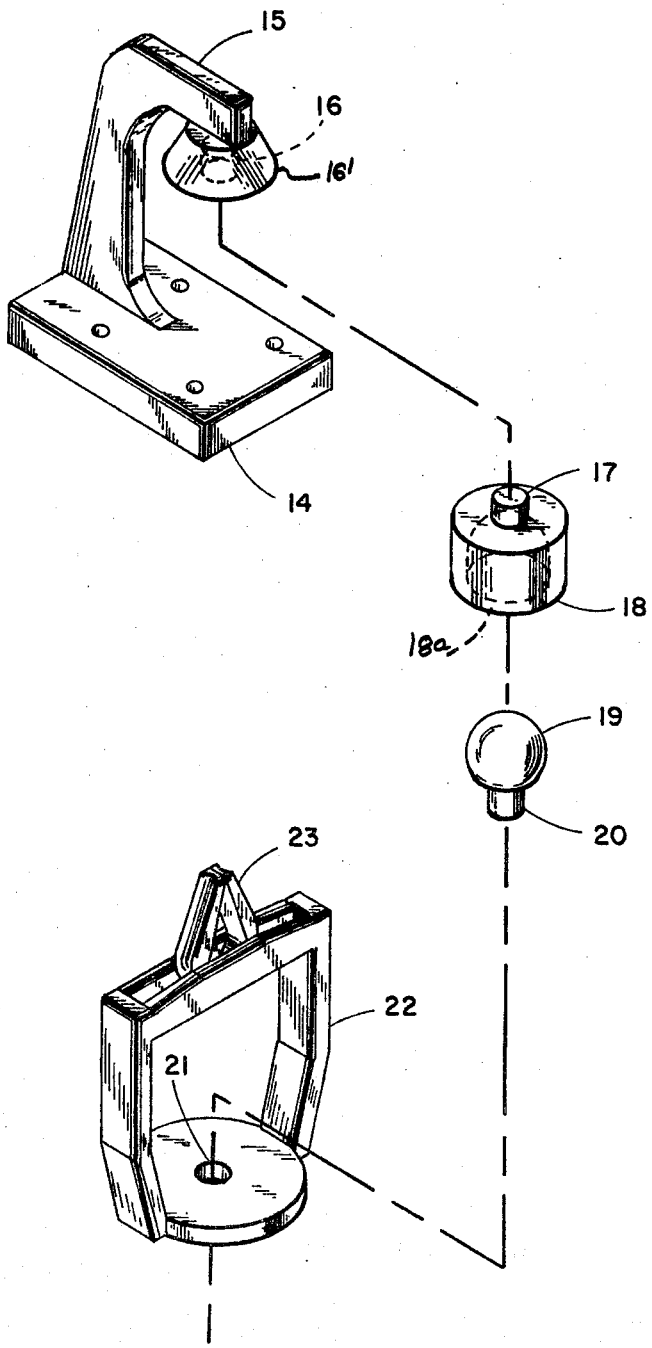
FIG. 2 depicts an exploded view of the invention.

Looking now to FIG. 2 of the drawings, the termination 10 is set forth in greater detail. The exact dimensions and relative strengths of the constituent elements will not be gone into at this point, it being understood that the termination is to be fabricated and dimensioned differently for smaller or larger floats.

A base portion 14 is provided with a number of holes to allow its being bolted onto a ballast or, in the alternative, the base portion can be welded onto the ballast. A C-shaped portion 15 is affixed to the base portion and has a hole 16 bored in a downwardly facing cup 16'.

The projection 17 on a retaining cup 18 is sized to frictionally fit inside of hole 16. A dome shaped cavity 18*a* is machined in the bottom of the retaining cup and has dimensions to correspond with the outer surface of a ball member 19. Retaining cup 18 is machined from an ultra high molecular weight, high density polyethylene resin and the ball member is a commercially available cast phenolic material. These materials were chosen for their low friction compatability, noncorrosive characteristics, availability, toughness and excellent abrasion resistance. Having the retaining cup or socket member mounted upside down increases the possibility that the ball and socket connection will be self-cleaning.

Coupled to the ball member is the projection 20 which is sized to frictionally fit in an opening 21 on a yoke member 22. The yoke 10 is a lightweight forging or a more substantially built welded arrangement sufficient to bear the tensile load of the tether and ball.

Figure 3:
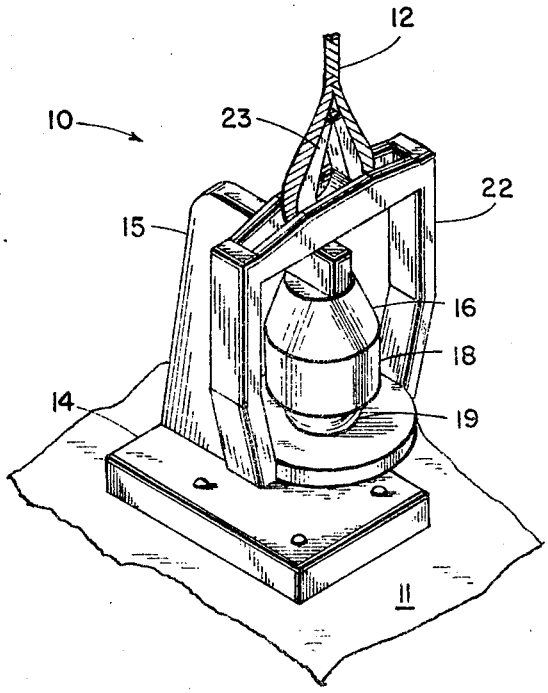
FIG. 3 is an isometric representation of the invention assembled.

In the embodiment depicted in FIG. 2 and in FIG. 3 a thimble 23 is welded onto a crossmember of the yoke. A thimble serves to prevent crushing of a synthetic or wire rope that is spliced back on itself. Optionally, the thimble on the yoke could be replaced by a swaged stud making the termination better adapted for a wire rope tether.

The termination thusly described relies on the ball and retaining cup or socket to bear the load created by the buoyancy of the float. Since the thimble or swaged stub on the yoke is rigidly affixed to the yoke, the tether will not be subjected to bending where it is coupled to the yoke but rather the ball and socket will pivot in accordance with displacements of the surface float.

Obviously, many modifications and variations of the present invention are possible in the light of the above teachings, and, it is therefore understood that within the scope of the disclosed inventive concept, the invention may be practiced otherwise than specifically described.

What is claimed is:

1. An apparatus for terminating a tether extending to a float maintained at and below the water-air interface onto a ballast comprising:

a C-shaped member mounted on the ballast and provided with a downwardly facing cup-shaped portion having a recess carrying a cylindrically-shaped member provided with a rounded downwardly facing cavity, the cylindrically-shaped member is fashioned from a material assuring a low friction surface and a rectangularly-shaped frame connected on one of its sides to the tether, the rectangularly-shaped frame has a rounded member mounted on a side opposite from where the tether is connected, the rounded member is configured to mate with the rounded cavity for mechanically cooperating therewith to allow tethered oscillations of the float over several million cycles.

2. An apparatus according to claim 1 in which the extension of the tether line, the rounded cavity and the rounded member are axially aligned to reduce moments.

3. An apparatus according to claim 2 in which the cylindrically shaped member is fashioned from polyethylene and the rounded member is formed from cast phenolic to reduce the problems associated with friction and corrosiveness.

* * * * *